United States Patent [19]

Kosak et al.

[11] Patent Number: 4,920,777

[45] Date of Patent: May 1, 1990

[54] METHOD AND REVERSING MILL TRAIN FOR ROLLING PARTICULARLY SHEET PILES

[75] Inventors: Dietmar Kosak, Neuss; Georg Engel, Kaarst, both of Fed. Rep. of Germany

[73] Assignee: SMS Schloemann-Siemag Aktiengesellschaft, Dusseldorf, Fed. Rep. of Germany

[21] Appl. No.: 137,754

[22] Filed: Dec. 24, 1987

[30] Foreign Application Priority Data

Dec. 24, 1986 [DE] Fed. Rep. of Germany ..... 3644353

[51] Int. Cl.[5] ..... B21B 13/10

[52] U.S. Cl. ..... 72/225; 72/229

[58] Field of Search ..... 72/225, 229

[56] References Cited

U.S. PATENT DOCUMENTS

| | | | |
|---|---|---|---|
| 410,107 | 8/1889 | Kennedy et al. | 72/225 |
| 4,291,564 | 9/1981 | Muckli | 72/225 |
| 4,334,419 | 6/1982 | Kishikawa et al. | 72/225 |
| 4,518,660 | 5/1985 | Faessel et al. | 72/225 |
| 4,637,241 | 1/1987 | Michaux | 72/225 |

*Primary Examiner*—W. Donald Bray

*Attorney, Agent, or Firm*—Toren, McGeady & Associates

[57] ABSTRACT

A method for rolling section steel, particularly sheet piles. The section steel is rolled successively in successive passes. At least always two of the passes are combined in a common two-high stand. Rough rolling is carried out in several passes in at least one universal stand, wherein the at least one universal stand is adjusted after each pass. Finish rolling is carried out in the conventional manner in the passes of subsequent stands. A reversing mill train for carrying out the method includes at least one universal stand, and edging stand following the at least one universal stand, and two-high roll stands following the edging stand.

6 Claims, 3 Drawing Sheets

METHOD AND REVERSING MILL TRAIN FOR ROLLING PARTICULARLY SHEET PILES

BACKGROUND OF THE INVENTION

1. Field of the Invention

The present invention relates to a method for rolling section steel, particularly sheet piles. The section steel is rolled successively in successive passes. At least always two of the passes are combined in a common two-high stand. The present invention further relates to a reversing mill train for carrying out this method.

2. Description of the Prior Art

Section steel, such as, sheet piles, are conventionally rolled in successively arranged passes of grooved rolls. Two, or at most three, of these passes can be provided in a set of rolls. Due to the widths of the passes rolls having substantial lengths are required. As a result, the rolls must have relatively large diameters in order to ensure that the stability of the rolls is sufficient. Since generally at least ten, but usually an even greater number of passes are required for rough rolling and finish rolling, at least five reversing two-high stands provided with box passes are required for a conventional reversing mill train for rolling sheet piles. Since the sets of rolls are long and have a large diameter, these two-high stands are also relatively large and, thus, expensive.

It is, therefore, the primary object of the present invention to reduce the expenses required for the stands and the roller tables, transfer beds, etc. used with the stands in the reversing mill train used for carrying out the above-described method.

SUMMARY OF THE INVENTION

In accordance with the present invention, rough rolling is carried out in several passes in at least one universal stand, wherein the at least one universal stand is adjusted after each pass. Finish rolling is carried out in the conventional manner in the passes of subsequent stands.

Thus, in accordance with the present invention, preferably a universal stand replaces the first stands which have the conventional box passes. In this universal stand, by means of the reversing method, several passes or a number of passes are rolled, wherein the horizontal rolls as well as the vertical rolls are adjusted after each pass. Consequently, this first stand carries out a rolling and forming work by means of grooved rolls which corresponds to the work carried out by, for example, three to eight conventional box passes. Also, the single universal stand replaces at least two, if not three, heavy two-high rolling stands having box passes. In addition, run-out tables connecting the stands and transfer beds connecting roller tables become unnecessary.

In accordance with an advantageous development of the invention, at least one edging pass is carried out between the passes of a universal roll stand. This edging pass serves to further shape the interlocking portions of sheet piles.

The method according to the present invention is carried out in a reversing mill train which includes at least one universal stand and at least one edging stand adjoining the at least one universal stand, wherein the at least one universal stand and the at least one edging stand are arranged ahead of the remaining grooved two-high roll stands.

It has been found to be particularly important to provide the universal stand as well as the edging stand with profiled rolls. The vertical rolls are advantageously provided with an upper cylindrical portion and a lower portion of increasing thickness, for example, in the shape of a parabola. The horizontal rolls approximately have the shape of a turned-over W with protruding outer ends. The rolls of the edging stand are also preferably profiled and have circumferential surfaces which are particularly effective in the areas of the roll body ends of the horizontal rolls.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there is illustrated and described a preferred embodiment of the invention.

DETAILED DESCRIPTION OF THE INVENTION

Figure 1:
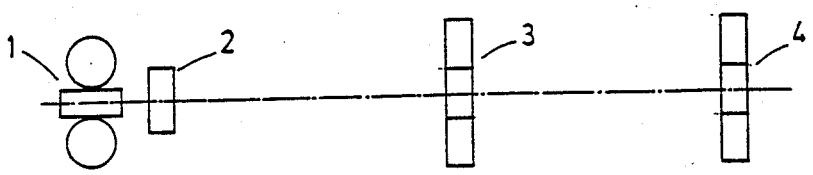
FIG. 1 is a schematic illustration of a reversing mill train.

FIG. 1 of the drawing is a schematic illustration of a reversing mill train which includes, successively in rolling direction, a universal stand 1, an edging stand 2 and two two-high roll stands 3 and 4 which in the illustrated embodiment each have three box passes as indicated by transverse lines between the schematically illustrated rolls. For simplicity's sake, the lengths of the roller tables have been shortened in FIG. 1 and any necessary transfer beds have been omitted. The universal stand 1 in connection with edging stand 2 replaces several heavy two-high roughing stands or leaders which are usually required at this location.

Figure 2:
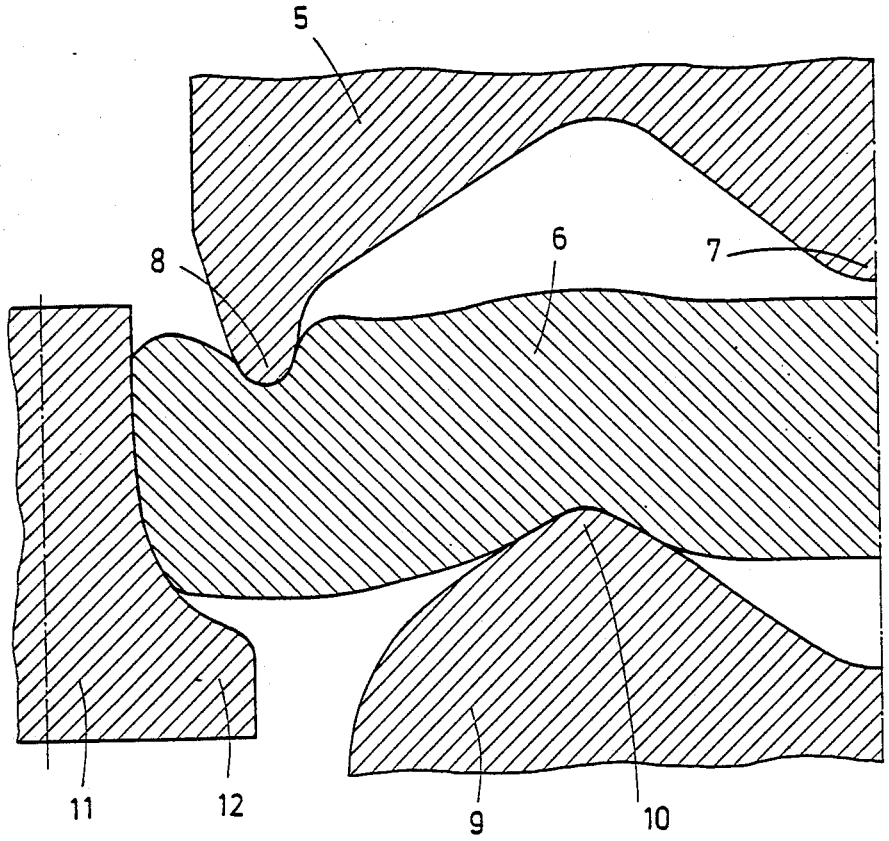
FIG. 2 is a schematic sectional view of portions of the rolls of a universal stand and of a slab to be rolled in the stand.

The rolls of universal stand 1 are shown partially in FIG. 2. In the position shown in FIG. 2, the universal stand 1 is still relatively wide open. A section to be rolled, for example, a slab 6, is rolled into universal stand 1. An upper roll 5 having a profile shaped like a turned-over W is worked into the slab 6. In particular, the protruding roll portion 7 in the middle portion of the body of the upper roll 5 will not make contact with the slab 6 during the first pass. However, the free ends of the W-profile of upper roll 5 forming shoulders 8 do penetrate into the slab 6.

A lower roll 9 acts on the slab 6 by means of two symmetrically provided shoulders 10. The sides of the pass are formed by vertical rolls 11. The body of each vertical roll 11 is cylindrical in the upper portion thereof and widens downwardly in the shape of parabola to form a shoulder 12. The slab 6 is several times moved through the universal stand in a reversing operation, wherein the rolls are adjusted closer toward each other after each pass until the desired shape of the rolled material is obtained. Thus, the method according to the present invention can be carried out with low expenditures for stands, rolls, roller tables and transfer beds.

Figure 3:
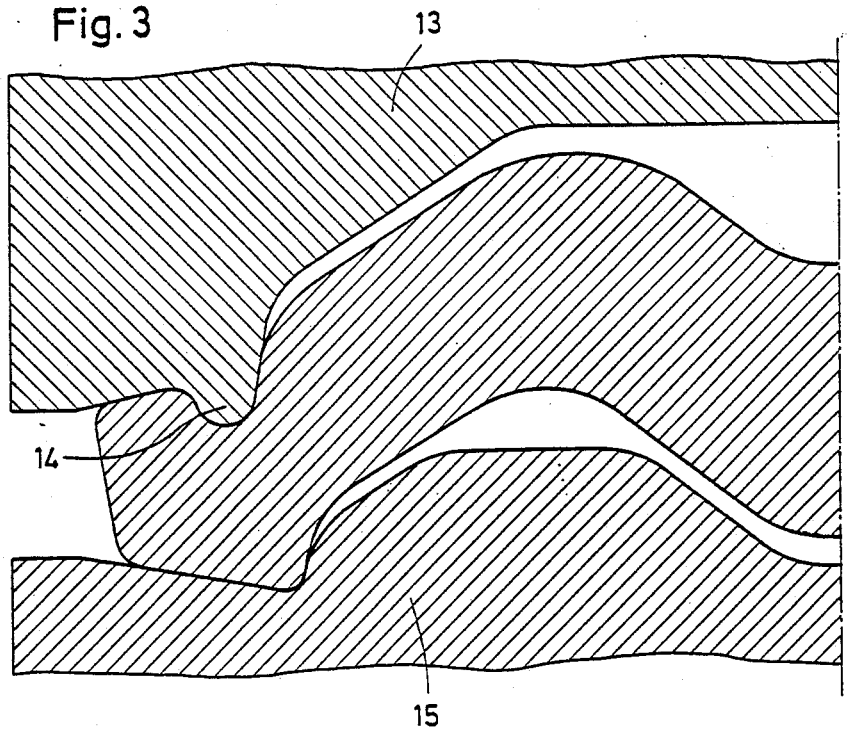
FIG. 3 is a schematic sectional view of the rolls of an edging stand.

Since a free space exists between the body of the vertical roll 11 and its shoulder 12 and the bodies of the horizontal roll 5, particularly its shoulders 8, the slab 6 may expand in an uncontrolled manner into this space toward the top and toward the outside. Therefore, an edging pass is carried out after one of the passes in the universal stand. Due to the shapes of the edging rolls partially illustrated in FIG. 3, particularly those portions of the rolled material 18 are reduced during the edging pass which correspond to the spaces between the rolls 5 and 11 of the universal stand 1 and which, therefore, are not reached by rolls 5 and 11. Accordingly, an improved and better defined shaping of the "fingers" in the interlocking portions of sheet piles is obtained.

Figure 4:
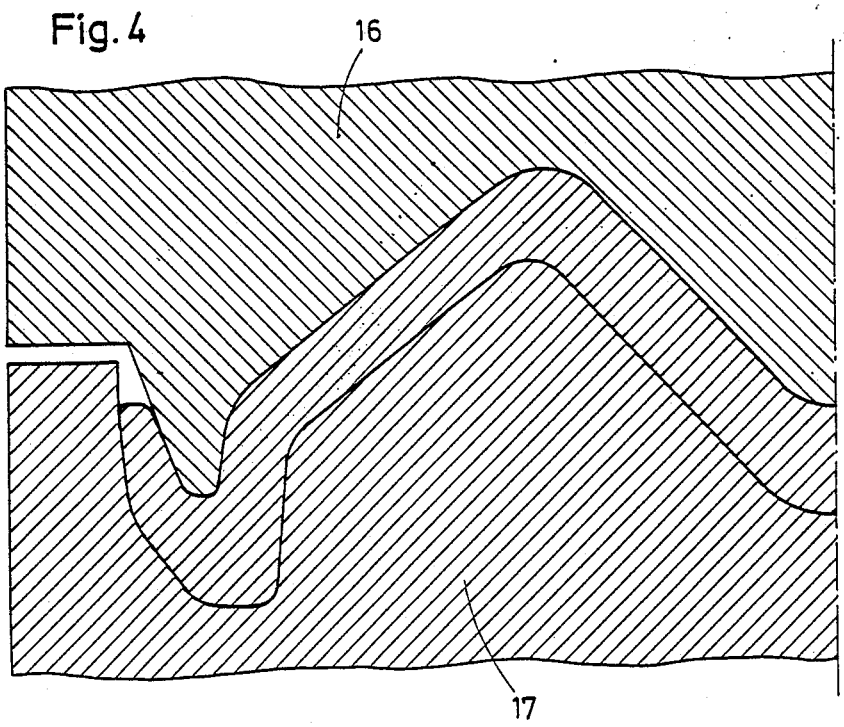
FIG. 4 is a schematic sectional view of a subsequently arranged two-nigh roll stand with box pass.
Figure 5:
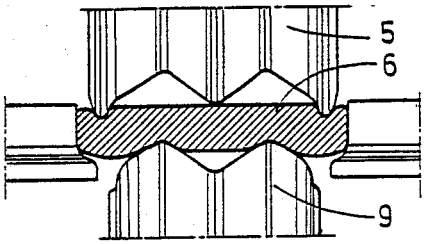
FIGS. 5 to 7 are schematic illustrations of successive passes of a universal stand.
Figure 8:
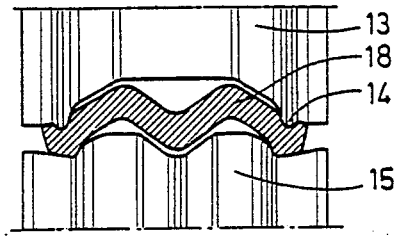
FIG. 8 is a schematic illustration of a pass of an edging stand.
Figure 6:
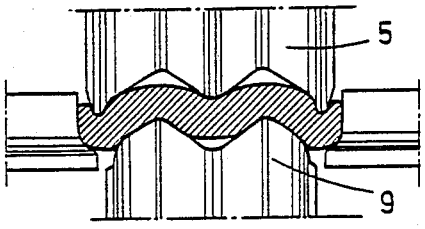

After several passes have been carried out in the universal stand, the resulting section is moved into the first of the subsequently arranged box passes of the two-high roll stands 3 and 4. The box passes provided between the work rolls 13 and 14 of the two-high roll stand 3 may have, for example, the shape indicated in FIG. 4 in which a set of rolls is partially illustrated in a schematic longitudinal sectional view. The desired final shape of the section is achieved by additional rolling in the box passes of the two-high roll stands 3 and 4.

It has already been recommended, for example, in Nippon Steel Mills, under the title "Nippon Steel's Rolling Technology", to use universal stands for rolling section steel, flat products and wires, and, for the rolling of sheet piles, tests with models of modeling clay have been mentioned. However, in these situations, the universal stands were not used for rough rolling, but were used for finish rolling.

The present invention, on the other hand, relates to rough rolling. In accordance with the present invention, several heavy roughing stands of a reversing mill train are to be replaced by a universal stand or by two universal stands. In the rough rolling step, it is possible to use a wide range of adjustments of the rolls for a relatively large number of passes to be carried out on the universal stand, so that the universal stand can be utilized to the fullest extent and one universal stand can replace several heavy roughing stands.

However, the present invention is not limited to the arrangement of a single universal stand. It is also possible to replace another one of the conventionally used roll stands by another universal stand. The single important aspect of the present invention resides in that finish rolling is carried out in the conventional manner, for example, in box passes, within narrow tolerances, so that, independently of the wide range of adjustments utilized during rough rolling, a finished product is obtained which meets narrow tolerances.

The sequence of FIGS. 5 to 10 schematically illustrates the first passes of a slab 6 to be rolled into a sheet pile. In the first pass of a universal stand shown in FIG. 5, particularly the shoulders 8 and 10 of the horizontal rolls 5 and 9 become effective. The slab 6 is further deformed in second and third passes illustrated in FIGS. 6 and 7 in which the final shape of the sheet pile is already approximately obtained, although the thickness of the slab is still too great. The fourth pass for the material 18 to be rolled is between the horizontal rolls 13 and 15 of an edging stand. Shoulders 14 act to make deeper the joint of the interlocking portion of the sheet pile already roughly formed in the previous passes. The portions of the rolls 13 and 15 outwardly adjacent to shoulders 14 contact the edge portions of the rolled material, i.e., the so-called "fingers", formed in the previous passes.

Figure 9:
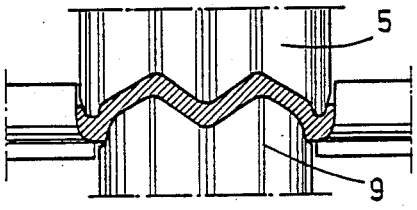
FIGS. 9 and 10 are schematic illustrations of subsequent passes of the universal stand.
Figure 7:
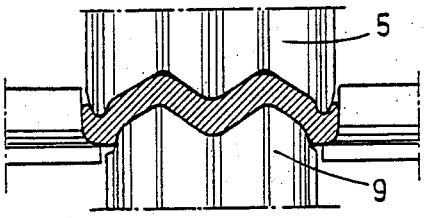
Figure 10:
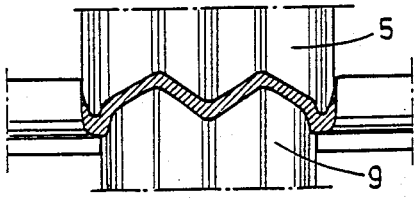

The additional passes of the universal stand illustrated in FIGS. 9 and 10 further substantially reduce the thickness of the material before the material is moved to subsequently arranged roll stands, not illustrated in the drawings.

In actual practice, the roll stands cannot be mounted spaced apart with the relatively short distances illustrated in FIG. 1. This is because each stand must be provided with run-out tables of sufficient length. The stands will frequently not be connected with roller tables which would have to have the appropriate length. Rather, at least some of the stands may be arranged parallel next to each other, so that the length of the building in which the rolling mill is housed can be reduced. However, this makes necessary the arrangement of transfer beds from one roller table to the next parallel roller table. Thus, in accordance with the present invention, fewer stands, roller tables and transfer beds are used and the carrier required for the rolling mill train becomes smaller.

While a specific embodiment of the invention has been shown and described in detail to illustrate the application of the inventive principles, it will be understood that the invention may be embodied otherwise without departing from such principles.

We claim:

1. In a method for rough rolling of sheet pile sections by carrying out passes in an adjustable rolling pass and bending and finishing rolling the sections by carrying out a plurality of passes in two-high roll stands and universal stands, the improvement comprising the rough rolling being effected in steps in at least one universal stand, the at least one universal stand being further adjusted after each pass.

2. The method according to claim 1, wherein rough rolling is effected in two successively arranged universal stands.

3. The method according to claim 2, comprising rolling at least one edging pass between the passes carried out in the universal stands, wherein the edging pass forms the interlocking portions of the sheet pile sections.

4. A rolling mill train for rough rolling of sheet pile sections, comprising at least one universal stand, the at least one universal stand being adjustable after each pass, and an edging stand for carrying out an edging pass following the at least one universal stand, wherein the at least one universal stand and the edging stand each have profiled rolls.

5. The rolling mill train according to claim 4, wherein the at least one universal stand includes vertical rolls and horizontal rolls, each vertical roll having a cylindrical upper portion and a lower portion connected to the upper portion, the lower portion being parabola-shaped and defining a shoulder, and wherein each horizontal roll essentially has the shape of a turned over W.

6. The rolling mill train according to claim 4, wherein the edging stand includes horizontal rolls, each horizontal roll having peripheral end portions, the peripheral end portions acting to form the interlocking portions of the sheet pile sections.

* * * * *